US005277315A

United States Patent [19]

Plein

[11] Patent Number: 5,277,315

[45] Date of Patent: Jan. 11, 1994

[54] PERSONAL CARRYING CONTAINER FOR CIGARETTE AND LIGHTER

[75] Inventor: Steve Plein, McHenry, Ill.

[73] Assignee: Plein Enterprises, McHenry, Ill.

[21] Appl. No.: 604,776

[22] Filed: Oct. 26, 1990

[51] Int. Cl.[5] ..... B65D 85/10; A45F 5/00

[52] U.S. Cl. ..... 206/270; 206/86; 206/89; 206/256; 220/8; 224/252

[58] Field of Search ..... 206/86, 87, 89, 94, 206/101, 236, 242, 259, 260, 265, 267, 270, 256; 224/230, 252; 220/8

[56] References Cited

U.S. PATENT DOCUMENTS

| | | | |
|---|---|---|---|
| 409,029 | 8/1889 | Elliott | 206/270 X |
| 1,273,264 | 7/1918 | Moran | 206/270 |
| 1,685,765 | 9/1928 | Morgan | 206/259 |
| 1,783,756 | 12/1930 | von Frankenberg | 206/270 X |
| 1,949,165 | 2/1934 | Krieger | 206/259 |
| 2,043,888 | 6/1936 | Denit | 206/87 |
| 3,388,706 | 6/1968 | Muirheid | 206/259 X |
| 3,976,194 | 8/1976 | Loredo | 206/87 |
| 4,000,812 | 1/1977 | Pisarski et al. | 206/87 |
| 4,190,148 | 2/1980 | Schade, II et al. | 206/89 |
| 4,852,729 | 8/1989 | conte | 206/86 |

FOREIGN PATENT DOCUMENTS

| | | | |
|---|---|---|---|
| 2301984 | 7/1974 | Fed. Rep. of Germany | 206/89 |

*Primary Examiner*—Bryon P. Gehman
*Attorney, Agent, or Firm*—Leydig, Voit & Mayer

[57] ABSTRACT

A container for carrying cigarettes and a cigarette lighter having two open compartments wherein one open compartment slidably engages the second open compartment to form a sealed interior. The container includes a clip structure for attaching the container to another object. The container's surface preferably includes a raised area, a portion of that area being ribbed, as well as a cloth pouch for enclosing the entire container.

3 Claims, 3 Drawing Sheets

FIG. 1
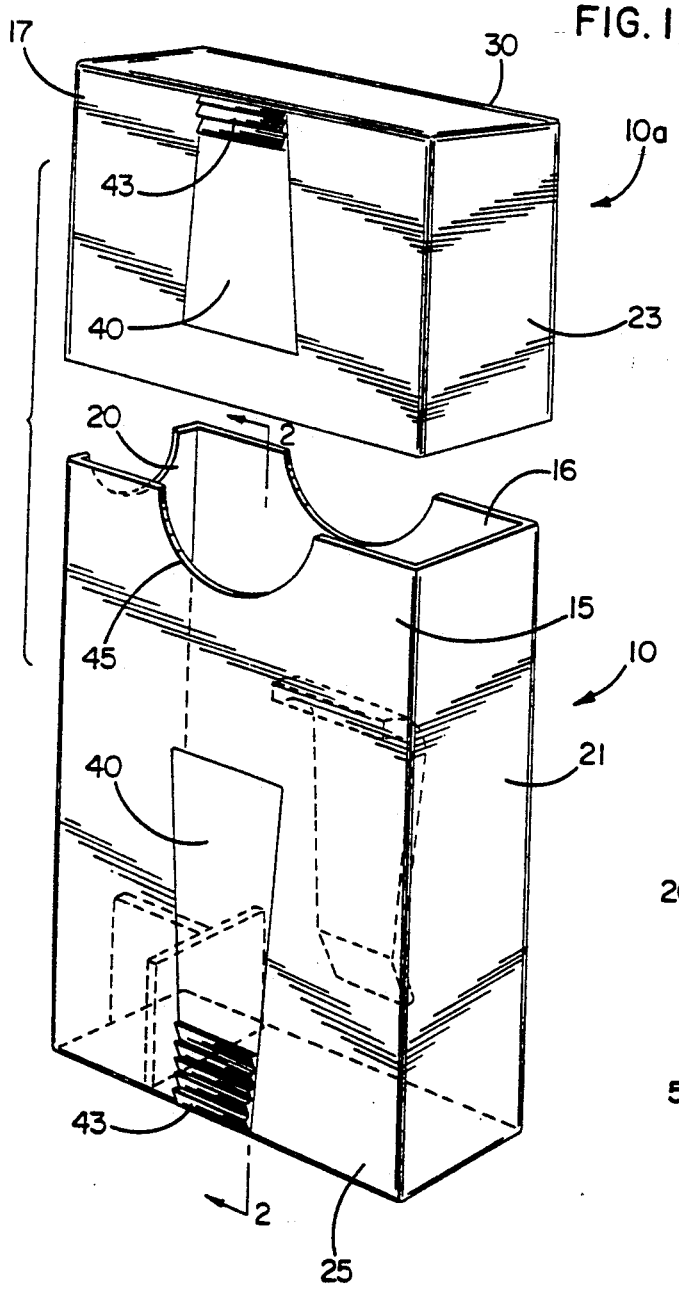
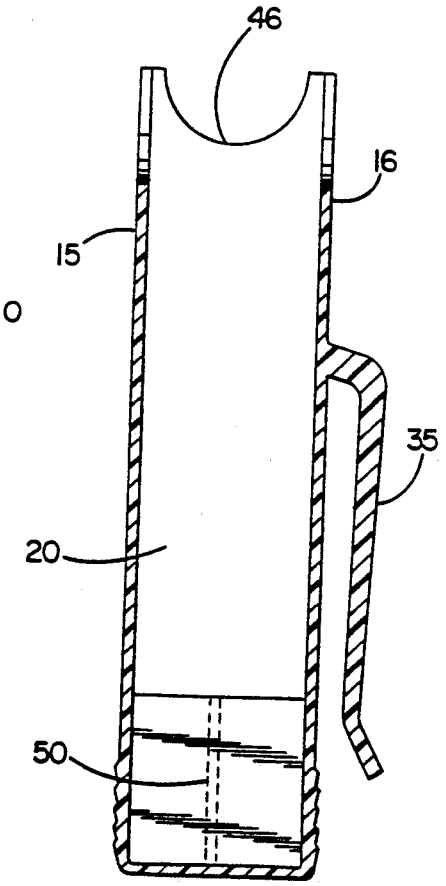
FIG. 2

PERSONAL CARRYING CONTAINER FOR CIGARETTE AND LIGHTER

BACKGROUND OF THE INVENTION

This invention relates generally to a container for cigarettes and a cigarette lighter and more specifically to a container for prepackaged cigarettes and disposable cigarette lighters.

Of great importance to cigarette smokers is easy access to their cigarettes and cigarette lighters, as well as safe storage of the cigarettes and cigarette lighter. As often is the case with cigarette smokers, the prepackaged and disposable lighters are carried on their person, many times in shirt pockets or pants pockets or in purses. Carrying the cigarettes and lighter in this manner makes the cigarettes and cigarette lighter readily accessible to the individual smoker.

However, problems arise when the individual is either wearing clothes without pockets or is in a situation where they are not able to carry a purse. Also during periods of physical activity where freedom of movement is desired, it is not feasible to carry a purse or to constantly cover ones shirt pocket to keep cigarettes from falling out. This problem of cigarettes falling out of one's pockets is magnified by the fact that it is common for cigarette smokers to leave the top of prepackaged cigarettes opened. Thus, the chance of spilling the cigarettes is increased during these periods of activity.

The container for a cigarette lighter and prepackaged cigarettes disclosed herein substantially eliminates these problems by safely securing the prepackaged cigarettes from damage, loss, or moisture damage while still allowing easy access to the cigarettes and lighter.

SUMMARY OF THE INVENTION

In accordance with the present invention, the problem of easy access to prepackaged cigarettes and easy access to disposable lighters as well as protection of cigarettes from damage or moisture are provided by the container disclosed herein.

The container is generally molded from a hard waterproof plastic which is formed into two open ended containers which are slidably engagable. The open ended containers are generally rectangular and box-like. The larger of the two containers (by volume) is considered the base, while the smaller open ended container is considered the lid. By placing the prepackaged cigarettes and disposable lighter within the larger container and slidably engaging the other container over that open container, a sealed interior is formed, thus protecting the prepackaged cigarettes and the disposable lighter from moisture as well as damage or loss. Furthermore, by enclosing the prepackaged cigarettes and disposable lighter within the container, the cigarette smoker can engage in activities while not fearing that the cigarettes will spill out causing either damage to the cigarettes or delay in having to pick them up again, as well as suffering economic loss.

The two open ended compartments, one being the lid, one being the base, have other special features which make them uniquely suited for prepackaged cigarettes and disposable cigarette lighters. The base section of the container is equipped with trenches cut into its top edge oriented near the open end. The trenches cut into the top edge of the walls allows the smoker to easily grasp the cigarettes and cigarette lighter without having to turn the container up-side down in order to remove them. Prepackaged cigarettes come in different sizes, regulars, 100's, kings, and the trenches in the base compartment are large enough to allow a smoker to remove different size packages quite easily.

The base compartment is equipped with a clip structure which is positioned on an outer flatwall of the compartment, allowing the compartment to be attached to either the individuals clothing or other objects allowing the cigarettes within the container to be securely stored without the need to resort to pockets or purses. The clip structure allows the individual to keep both hands free and engage in activities, including those associated with water activities. Thus, when the top compartment is slidably engaged over the base compartment, and the clip structure is used, the smoker can freely participate in water sport activities or other physical activity without fear of losing cigarettes or losing cigarettes to moisture damage and at the same time having the cigarettes near for immediate access. For example, the clip structure can be utilized to clip the container to an automobile sun visor, or the like, to free the smoker's hands for driving.

Both the lid compartment and the base compartment have a raised ribbed area on a portion of its exterior surface allowing for easy gripping of the container by the smoker when opening and closing the container. The top compartment and base compartment are also equipped with a portion of raised flat surface area which allows for decals or designs or other ornamentation to be placed on the container.

The invention may also be used to enhance conventional storage means. That is, the invention can be used in shirt pockets and in purses for added protection and the user can utilize the clip structure and the sealed container to securely store the cigarettes and lighter as well as provide additional protection from damage.

Finally, the container in its closed position, may be carried in a pouch which allows easy access to the container as well as allowing the clip structure to protrude through the cloth portion. With the clip structure protruding through the pouch, the container may still be securely attached to clothing or other articles. The pouch protects the container from scratches as well as stopping the container from scratching other surfaces.

OBJECTS OF THE INVENTION

One object of this invention is to provide a moisture-resistant, crush-proof container for prepackaged cigarettes and a disposable lighter.

Another object is to allow easy access to prepackaged cigarettes and disposable lighters by allowing the cigarettes and lighter to be carried without resorting to pockets or purses.

Another object of the invention is to provide a safe storage container that is easily accessible and easily opened and closed thus allowing adequate protection and good accessibility.

Other objects and advantages of the invention will become apparent upon reading the following detailed description and appended claims, and upon reference to the accompanying drawings.

BRIEF DESCRIPTION OF THE DRAWINGS

The present invention will be better understood from a review of the detailed description of the illustrative embodiments with reference to the drawing in which:

FIG. 1 is a perspective view showing the detached lid and the base compartment.

FIG. 2 is a side view of the base portion of the invention.

DETAILED DESCRIPTION OF THE PREFERRED EMBODIMENT

Figure 3:
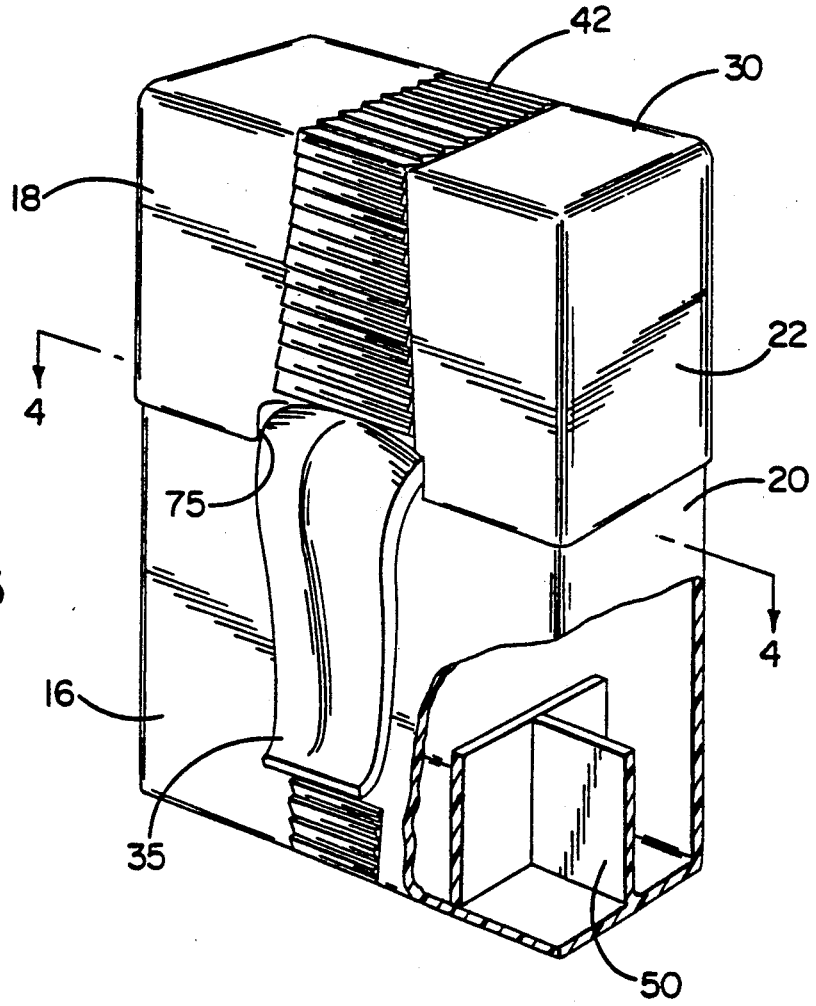
FIG. 3 is a perspective view of the container with the lid engaged and a cut-away portion showing the interior of the base compartment.
Figure 4:
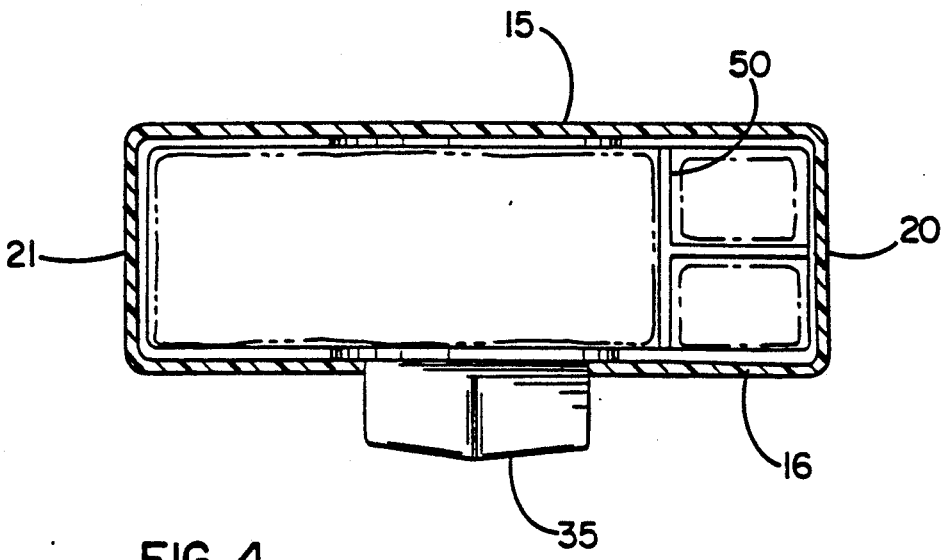
FIG. 4 is a top view of the base compartment looking to the inside of the base compartment.
Figure 5:
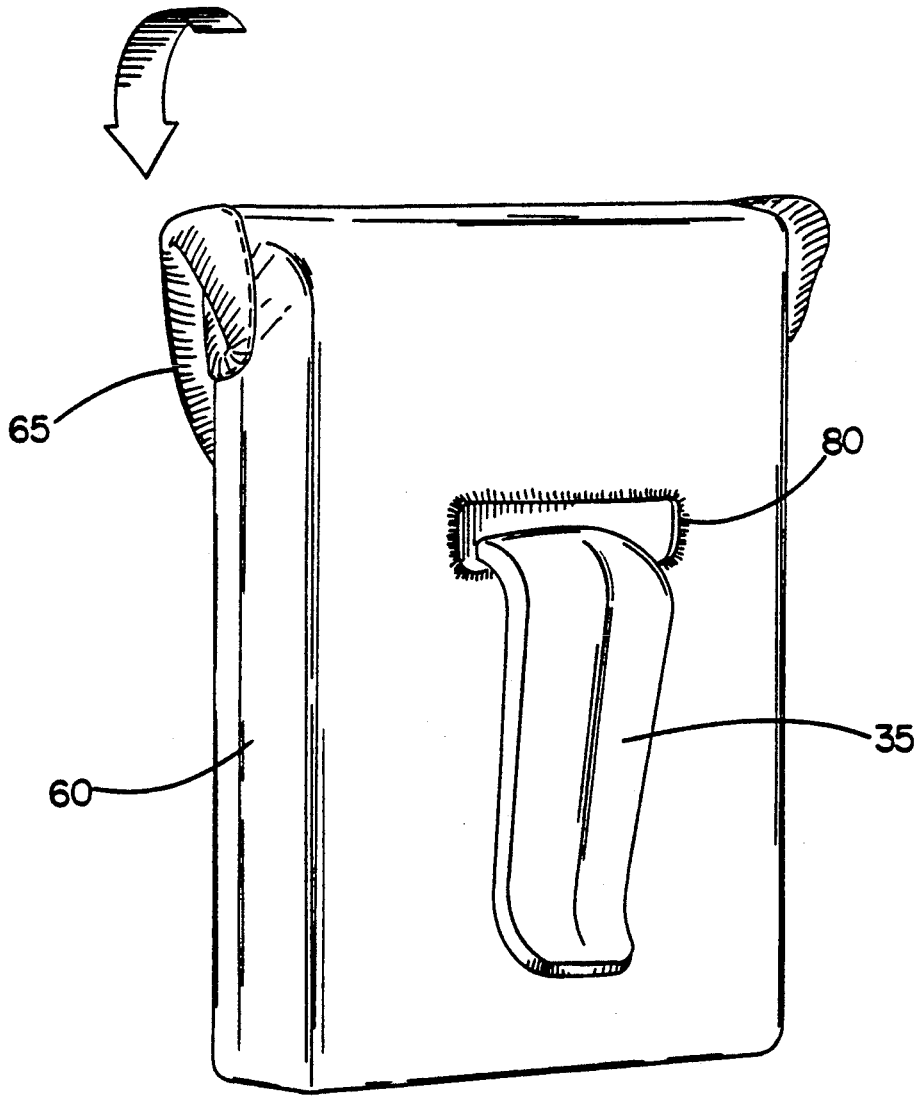
FIG. 5 is a perspective view of the closed container inside the cloth pouch.

FIG. 1 shows generally the container 10 with detachable lid designated as 10*a*. The opposite side of the container 10 is shown generally in FIG. 3.

In the container 10 disclosed herein, flat walls 15, 16 are connected at each of their vertical edges to the vertical edges of side walls 20, 21. Flat walls 15, 16 and side walls 20, 21 are sealingly attached at their lower edges to the perimeter of base 25 forming a sealed compartment open at one end.

The detachable lid designated generally as 10*a* is arranged in much the same way. Flat walls 17, 18 are connected at each of their vertical edges to the vertical edges of side walls 22, 23. Flat walls 17, 18 and side Walls 20, 23 are sealingly attached at their upper horizontal edges to the perimeter of top 30 forming a sealed compartment open at one end. The sealing is preferably by molded plastic, but can be any other suitable method such as adhesive or welding or the like.

The surface area and dimensions of top 30 and the perimeter of the open end of lid 10*a* are slightly larger than the open end of container 10. The open end is formed by the upper horizontal edges of flat wall 15, 16 and side wall 20, 21 to allow lid 10*a* to fit slidably over container 10 forming a sealed compartment. In the preferred embodiment, the length, width and height of container 10 is 2.875 inches by 0.875 inches by 4.1 inches, whereas the length, width and height of lid 10*a* is 2.975 inches by 0.975 inches by 1.75 inches respectively.

In the preferred embodiment, the flat walls 15, 16 and side walls 20, 21 and flat walls 17, 18 and side walls 22, 23 are made of polypropylene plastic which is relatively crush proof. Therefore, when the lid 10*a* is slidably engaged over container 10, the contents of the container are safe against damage from crushing, moisture, and secured from falling from the container. This moisture protection referred to above makes the container especially suited for protecting and carrying cigarettes and a cigarette lighter while a smoker is participating in or near water sport activities such as swimming, boating, waterskiing, or the like. The usefulness of this invention is not limited to the protection of cigarettes and cigarette lighters of smokers engaging in water sport activities, but those activities serve as an example of occasions where the risk of moisture damage to the cigarettes and cigarette lighter is increased.

The container 10 described herein not only protects cigarettes and lighters from damage, but it also provides an easily accessible means for carrying cigarettes and a cigarette lighter. The clipping attachments and grasping means detailed below provide an effective means for carrying cigarettes and a cigarette lighter when other means may not be available or to enhance already available means. When a smoker is wearing shirts without pockets or is not carrying a purse or other carrying means for cigarettes and a lighter, the clip attachment of the container provides a means for keeping the cigarettes and lighter accessible without tying up the hands of the smoker. Similarly, the clip attachment can secure the container to an automobile sun visor to free the smoker's hand for driving.

Referring to FIGS. 1, 3 in order to facilitate easy opening and closing of container 10, top 30 and back flat walls 16 and 18 have a portion of raised ribbed surface area 42 to create a surface with a greater coefficient of friction enabling the container 10 and lid 10*a* to be grasped securely by the fingers of the smoker when opening and closing the container. The ribbed surface 44 is located substantially in the middle of the lid and extends along both sides and the top. The ribbed surface 44 is preferably 0.75 inches wide, or about the width of a thumb. Flat walls 15 and 17 also have a raised 5 surface area 40. Surface area 40 is ribbed at the lower end of flat wall 15 and at the upper end of flat wall 17. The portion of ribbed surface of raised surface area 40 is designated as 43. A large enough portion of the raised surface 40 is ribbed at either end to allow the individual to contact the ribbed portion with his thumb on one side of the container. Another finger of the same hand contacts ribbed surface area 43 on the other side of the container which provides an indication of where to grasp the container as well as a no-slip surface contact area for grasping the container when slidably engaging and disengaging lid 10*a* from container 10. The ribbed portion 42 of the lid 10*a* allows for the same no-slip surface area to be contacted by the smoker's thumb and finger. Therefore, grasping the container securely is made easier by increasing the coefficient of friction at the point where an individuals hands would contact the container for opening and closing.

Once the lid 10*a* is removed from container 10 the efficiency of inserting or removing a pack of cigarettes or cigarette lighter from the container 10 is increased by having trenches 45 in the top of flat walls 15, 16. The trenches 45 are aligned axially and are cut deep enough and wide enough so that a portion of the box of cigarettes (not shown) situated within the container 10 occupies the space between the trenches 45 allowing the box of cigarettes to be grasped by the fingers of the individual and removed from the container. Even though cigarettes are manufactured in different sizes, the trenches 45 are cut deep enough such that prepackaged cigarette boxes of all sizes will occupy the space between trenches 45 allowing the box to be easily grasped. Alternatively, the trenches can be raised or lowered to fit different sizes of packages.

An additional trench 46 is cut into side wall 20 which allows a cigarette lighter within container 10 to be easily grasped and removed from the container. Alternatively, the additionally trench can be sized and located to hold a standard pack of matches.

Generally, conventional disposable cigarette lighters are shorter in length than a standard box of cigarettes. Therefore, container 10 is equipped with a platform 50 attached to base 25. Platform 50 is oriented closer to side wall 20 which has trench 46 at its top edge. Platform 50 situates the disposable lighter such that a portion of the disposable lighter is raised above the lowest point of trench 46 allowing the smokers fingers to easily access the disposable lighter.

Additionally, on the back of container 10 attached to flat wall 16 is a clip structure 35. Clip structure 35 is an elongated S-shaped structure attached at one end to the upper portion of flat wall 16. The other end of structure 35 is unattached. A lower portion of clip structure 35 near the unattached end rests against the lower portion of flat wall 16. The lower portion of structure 35 resting against flat wall 16 may be pulled away from flat wall 16 near the bottom of flat wall 16 allowing a portion of clothing to be inserted between structure 35 and flat wall 16. Once the clothing is inserted between the lower end of structure 35 and flat wall 16, structure 35 pinches the clothing between itself and the flat wall 16 thus attaching container 10 to the clothing. It should be understood that the container is not limited to attachment to clothing only, but may be attached to any object or article that is shaped such that it can be pinched between structure 35 and flat wall 16.

Furthermore, the force applied by the lower portion of clip structure 35 against flat wall 16 is great enough to keep the inserted clothing from retracting, and is great enough to hold the container to the clothing when the container is full of cigarettes and a cigarette lighter. In the preferred embodiment the clip 35 and the first open compartment are molded as one piece. Alternatively, a piece of spring steel may be inserted in the clip structure 35 during the molding process.

In the preferred embodiment, in order to achieve the aforementioned protection of the cigarettes from moisture, lid 10*a* must be completely slidably engaged over container 10. In order to facilitate this function, flat wall 18 of lid 10*a* has a notch 75 cut into its lower edge to provide space for the top attached portion of structure 35. Therefore, lid 10*a* can be slidably engaged over the entire length of flatwalls 17, 18 allowing top 30 to sealingly engage the perimeter formed by the top edges of flat walls 15, 16 and side Walls 20, 21.

In the preferred embodiment, a portion of flat walls 15 and 17 have a smooth raised surface 40. This smooth raised surface allows for the addition of stickers, decals or other ornamentation. In an alternative embodiment, flat walls 15, 16, 17 and 18 are smooth and flat except for ribbed portion 43. This allows for labelling substantially the entire front and back surface area of the container 10.

In another embodiment, the invention includes a soft cloth pouch 60 having an extended flap 65 capable of folding over pouch 60 to form a sealed interior. At one end of flap 65 is one element of a VELCRO® system which may be attached to the other VELCRO® element located on pouch 60, such that flap 65 folds over the open end of pouch 60 forming the sealed interior. The use of VELCRO® is well known in the art as a fastening device.

The soft pouch 60 is shaped such that container 10 and lid 10*a* may be inserted, and flap 65 closed over pouch 60 completely covering container 10 and lid 10*a*. The soft pouch also includes an opening 80 allowing for the clip structure 35 to protrude through the cloth pouch 60 thus enabling the container 10 to utilize clip structure 35 and to be attached to another object even while in the closed pouch.

From the above description it is apparent that the objects of the present invention have been achieved. Although certain embodiments have been set forth, alternate embodiments and various modifications will be apparent from the above description to those skilled in the art. For example, a variety of clipping or attachment structures are possible. These and other alternatives are considered equivalents and within the spirit and scope of the present invention.

What is claimed is:

1. A container comprising:

a first open compartment having a pair of substantially parallel flat walls interconnected with a pair of substantially parallel side walls, said side walls and flat walls being interconnected with a bottom wall;

a second open compartment having a pair of substantially parallel flat walls connected to a pair of substantially parallel side walls, said side walls and flat walls being interconnected to a top wall; said second open compartment being slidably engageable over said first open compartment to form a sealed interior;

attachment means including a clip structure for attaching at least one of said first and second open compartments to another object and one of said second open compartment's flat walls having a notched edge adjacent to said open end allowing space for the top portion of the clip structure whereby said second open compartment may completely sealingly engage said first open compartment.

2. A container comprising: a first open compartment having a pair of substantially parallel flat walls interconnected with a pair of substantially parallel side walls, said side walls and flat walls being interconnected with a bottom wall;

said first open compartment further including a large compartment capable of accepting a package of cigarettes and a small compartment capable of accepting a cigarette lighter, said small compartment including a platform for supporting said cigarette lighter at a predetermined height;

said flat walls having trenches cut along the edge of said flat walls at the open end of said first open compartment; and one of said side walls having a trench cut along the edge of said side wall at the open end of said first open compartment;

said flatwalls further including a raised surface extending from the edge opposite said bottom wall and converging toward the edge adjacent to said bottom wall, said raised surface having an upper portion and a lower portion, said lower portion being ribbed;

a second open compartment having a pair of substantially parallel flat walls interconnected with a pair of substantially parallel side walls, said side walls and flat walls being interconnected with a top wall;

said second open compartment's parallel flat walls having a raised surface starting at the edge adjacent to the top wall and diverging toward the open end of said second open compartment, said raised surface having an upper portion and a lower portion, said upper portion being ribbed, said top wall also having a portion of its surface raised;

attachment means including a clip structure for attaching at least one of said first and second open compartments to another object, said clip structure being S-shaped and connected at a first end to the face of one of said flat walls of said first open compartment and having a second end oriented substantially near the bottom of said flat wall, said second end capable of being raised above the surface of one of said flat walls;

said second open compartment being slidably engageable over said first open compartment, wherein one of said flat walls of said second open compartment has a notched edge adjacent to said open end allowing space for the top first end of said clip structure whereby said second open compartment may completely sealingly engage said first open compartment.

3. A container in accordance with claim 2 further comprising:

a pouch having an open end including an attached flap which folds over said open end of said pouch and attaches to said pouch enclosing said container in said pouch, said pouch having an opening on one side wherein said clip structure of said container protrudes through said pouch.

* * * * *